US006743000B2

(12) United States Patent
Fernandez

(10) Patent No.: US 6,743,000 B2
(45) Date of Patent: Jun. 1, 2004

(54) HYDRAULIC PUMP WITH FLOW GUIDER

(75) Inventor: Jose Luis Fernandez, Bergara (ES)

(73) Assignee: Fagor, S. Coop., Mondragon (ES)

( * ) Notice: Subject to any disclaimer, the term of this patent is extended or adjusted under 35 U.S.C. 154(b) by 0 days.

(21) Appl. No.: 10/196,971

(22) Filed: Jul. 16, 2002

(65) Prior Publication Data

US 2003/0017065 A1 Jan. 23, 2003

(30) Foreign Application Priority Data

Jul. 20, 2001 (ES) ..... 200101705

(51) Int. Cl.[7] ..... F04B 17/00; F03B 11/04

(52) U.S. Cl. ..... 417/423.14; 417/423.7; 415/56.1

(58) Field of Search ..... 417/423.1, 423.7, 417/423.14, 540; 415/56.6, 56.1, 56.2, 56.4, 56.5, 204, 206

(56) References Cited

U.S. PATENT DOCUMENTS 984,456 A * 2/1911 Trenary ..... 415/197
1,993,268 A * 3/1935 Ferguson ..... 415/56.4
2,006,590 A * 7/1935 Ferguson ..... 415/56.1
3,266,428 A * 8/1966 Feith et al. ..... 415/56.1
3,656,861 A * 4/1972 Zagar ..... 415/109
4,172,695 A * 10/1979 Uesugi ..... 417/423.14
4,759,690 A * 7/1988 Deschamps et al. .... 416/186 R

OTHER PUBLICATIONS

Mark's Standard Handbook for Mechanical Engineers, 10$^{th}$ Ed., McGraw–Hill, Boston Mass., 1996; p. 15–40, column 2.*

* cited by examiner

*Primary Examiner*—Justine R. Yu
*Assistant Examiner*—Timothy P. Solak
(74) *Attorney, Agent, or Firm*—The Kline Law Firm

(57) ABSTRACT

A synchronous hydraulic pump for dishwashers and washing machines comprising a synchronous motor (1), an impeller (2) coaxial to said synchronous motor (1) and a hydraulic body (3), said impeller (2) being housed in said hydraulic body (3) and the hydraulic body (3) having an inlet pipe (4) and an outlet pipe (5). The pump also comprises at least one piece (8) adjacent to the impeller (2), said piece (8) having a projection (9) pointing at the outlet pipe (5), in such a way that said projection (9) acts as a guider directing the flow circulating inside the hydraulic body (3) towards the outlet pipe (5).

10 Claims, 3 Drawing Sheets

HYDRAULIC PUMP WITH FLOW GUIDER

TECHNICAL FIELD

The present invention relates to hydraulic pumps for dishwashers and washing machines, and more specifically to synchronous hydraulic pumps.

BACKGROUND OF THE INVENTION

Synchronous hydraulic pumps for dishwashers and washing machines are already known. Said pumps comprise a synchronous motor, an impeller coaxial to said synchronous motor and a hydraulic body, said impeller being housed in said hydraulic body. The hydraulic body has an inlet pipe and an outlet pipe, the incoming water being evacuated from the former to the latter pipe by means of the rotation of the impeller.

Pumps of this type usually have priming problems due to the air that builds up together with the water inside the hydraulic body. One solution so that the least possible amount of air collects inside the hydraulic body is to reduce the space inside said hydraulic body (and therefore the place where air could be housed) to a minimum. This is often not feasible due to the hydraulic or dimensional requirements of the housing where the pump is installed.

Another solution is to force out the air that collects inside the hydraulic pump adding a third pipe to the hydraulic body at the top, via which the air is evacuated to the exterior, being forced out to the washing chamber. The existence of said third pipe for air recirculation nevertheless brings about a loss of output flow, a loss that will be greater the larger the diameter of the third pipe is. Therefore, so that the flow loss may be as little as possible, small diameters are used in relation to the diameter of the outlet pipe. This means that, during the lifetime of the appliance, said third pipe becomes blocked and requires the intervention of the technical service. In addition, dirty water recirculates through said third pipe to the washing chamber, thereby reducing the washing quality of the appliance.

On the other hand, it is important to increase the output flow of the pump as much as possible. One way to do so is to increase the impeller's dimensions, but this entails higher power consumption along with noisier pump operation.

DESCRIPTION OF THE INVENTION

The main object of the invention is to provide a synchronous hydraulic pump that overcomes the priming problem without the need to incorporate a third pipe for air recirculation.

The hydraulic pump of the invention comprises a synchronous motor, an impeller coaxial to said synchronous motor and a hydraulic body, said impeller being housed in said hydraulic body and the hydraulic body having an inlet pipe and an outlet pipe. Said pump also comprises at least one piece adjacent to the impeller which has a projection pointing towards the outlet pipe, in such a way that said projection acts as a guider directing the flow circulating inside the hydraulic body towards said outlet pipe.

In this way, a good proportion of the mass of water is prevented from circulating permanently "integral" with the impeller together with the accumulated air. Thus, the air that would otherwise build up inside the hydraulic body is forced out via the outlet pipe, along with the mass of water, so that the priming problem is resolved. Furthermore, besides overcoming the priming problem, directing the flow also increases output delivery considerably.

Therefore, the invention has the following advantages:

- the priming problem is solved without the use of a third pipe for air recirculation, whereby the drawbacks stemming from the use of this third pipe are avoided, and
- a considerable output flow is obtained without having to increase the dimensions of the impeller, whereby the increased power consumption that would be involved is avoided, and also the increased noise level entailed.

The piece that acts as a guider directs the flow towards the outlet pipe irrespective of the direction of rotation of the impeller.

DETAILED DISCLOSURE OF THE INVENTION

Figure 1:
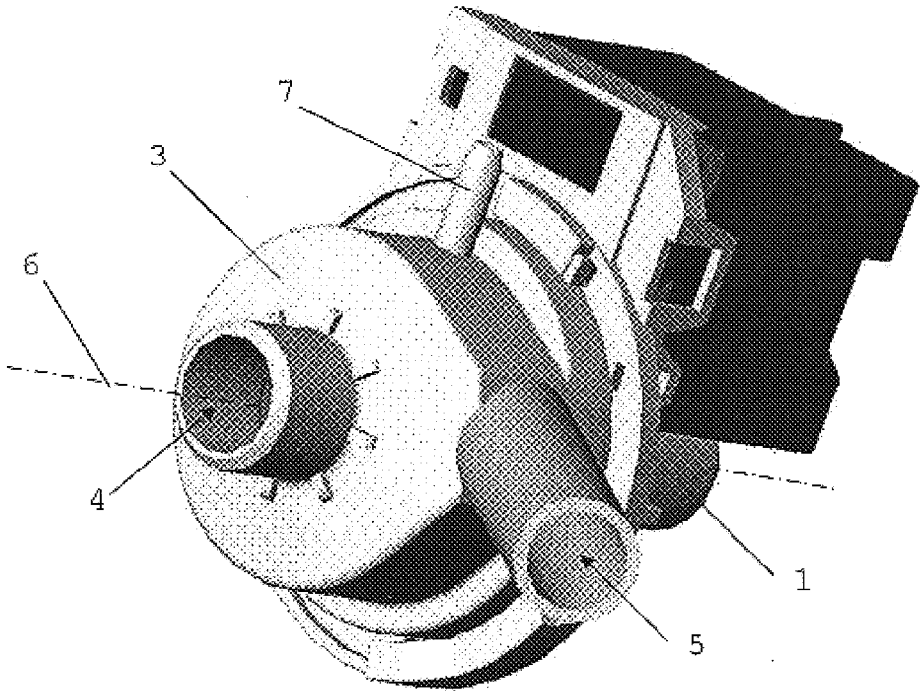
Prior Art Fig. 1
FIG. 1 is a perspective view of a synchronous hydraulic pump of the prior art.

The synchronous hydraulic pump of FIG. 1 include a synchronous motor 1, an impeller 2 (not shown in this FIG. 1) coaxial to said synchronous motor 1 and a hydraulic body 3 where the impeller 2 is housed, said hydraulic body having an inlet pipe 4 and an outlet pipe 5. The impeller 2 rotates in relation to the shaft 6.

The pump of FIG. 1 includes a third pipe 7 at the top for air recirculation. It may be observed that the diameter of the third pipe 7 is considerably smaller than the diameter of the inlet pipe 4 and the outlet pipe 5.

A third pipe is not needed on the pump of the invention. Experimental tests carried out with the hydraulic pump of the invention have shown that the output delivery that is obtained with the layout of the invention is increased considerably in relation to that obtained with the pump of FIG. 1.

Figure 2:
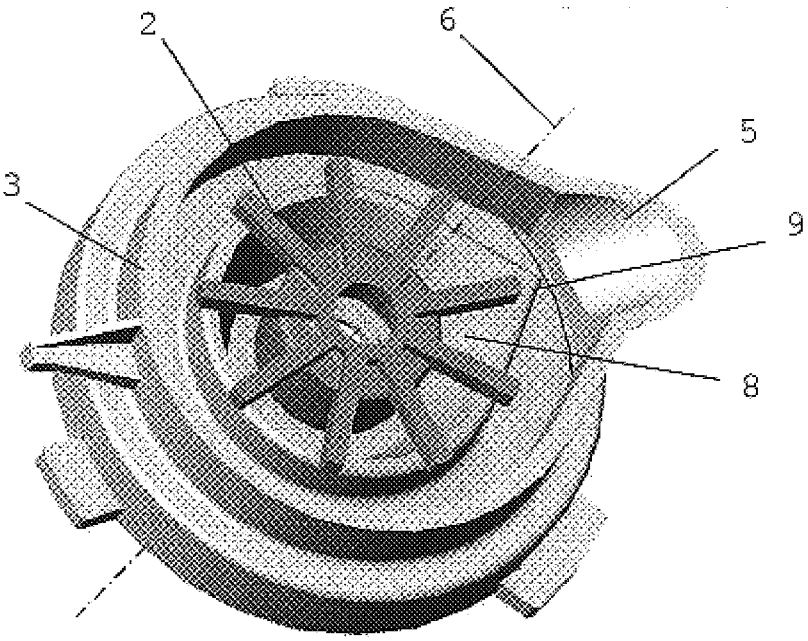
FIG. 2 is a cross-sectional perspective view of the lower half of a hydraulic pump according to a first embodiment of the invention.
Figure 3:
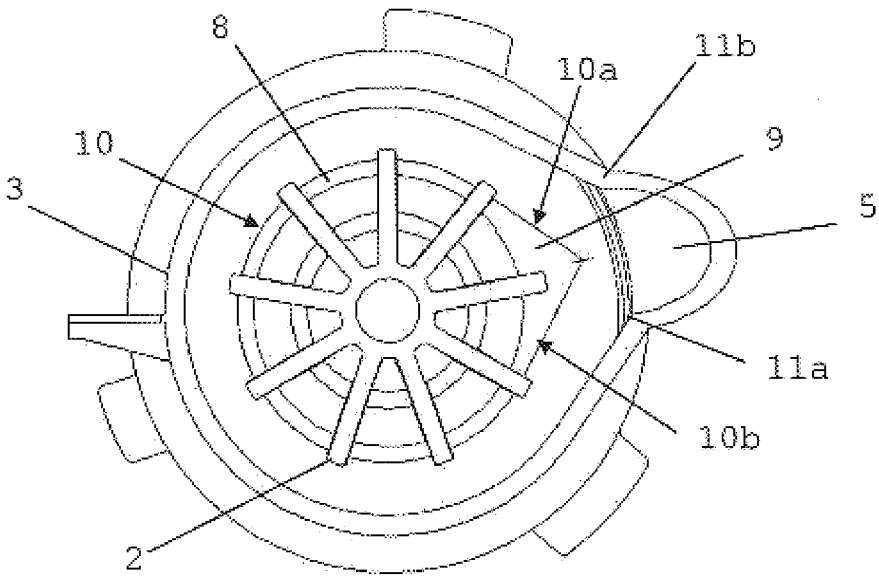
FIG. 3 is a cross-sectional plan view of the lower half of the hydraulic pump of the embodiment of FIG. 1.

The cross-sectional views of FIGS. 2 and 3 show a first embodiment of the invention. The sectional plane is perpendicular to the shaft 6 of the impeller 2 and the lower half of the pump is shown, as it is the part of the pump that is modified in this first embodiment.

In this first embodiment, the pump includes, under the impeller 2, a piece 8 provided with a projection 9 pointing towards the outlet pipe 5, so that this projection acts as a guider directing the flow circulating inside the hydraulic pump 3 towards said outlet pipe 5.

The piece 8 is placed between the impeller 2 and the synchronous motor 1, attached to said synchronous motor 1. Said piece 8 may also be integral with the body of the synchronous motor 1. The piece 8 is coaxial to the impeller 2 and has a substantially cylindrical outline 10 all around its outside edge, except at the projection 9, which is formed, as shown in FIG. 3, by two planes 10*a* and 10*b* tangential to said cylindrical outline 10 which extend on towards the outlet pipe 5 until both planes intersect. The intersection may be in the form of a sharp edge or else have a slight rounded outline.

As shown in FIG. 3, both plane 10*a* and plane 10*b* extend approximately towards the vertex of the outlet pipe 5 farthest away in relation to the point from where they start.

Figure 4:
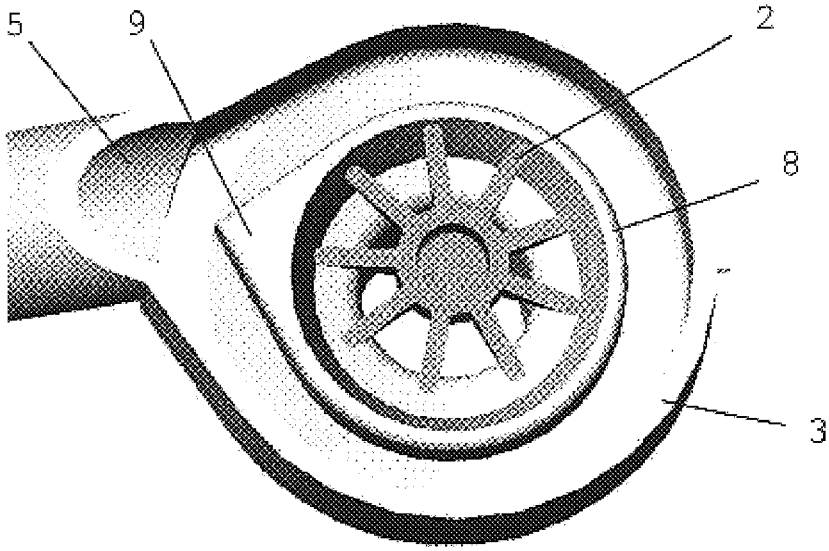
FIG. 4 is a cross-sectional perspective view of the upper half of a hydraulic pump according to a second embodiment of the invention.
Figure 5:
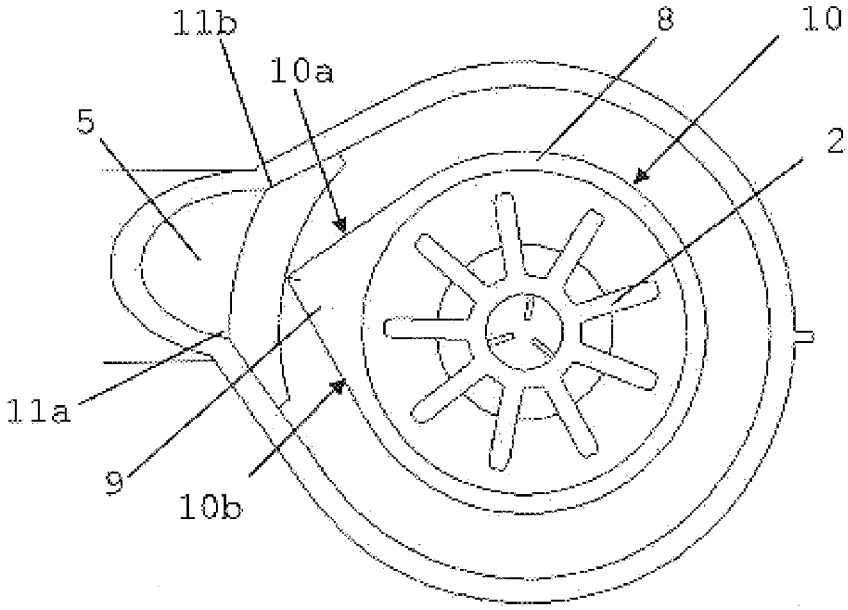
FIG. 5 is a cross-sectional plan view of the upper half of the hydraulic pump of the embodiment of FIG. 4.

The cross-sectional views of FIGS. 4 and 5 show a second embodiment of the invention. The cross-sectional plane is perpendicular to the shaft 6 of the impeller 2 and shows the upper half of the pump, as it is the part that is modified in this second embodiment.

In this second embodiment the piece 8 is above the impeller 2 and is integral with the hydraulic body 3. Said piece 8 may also be an independent piece attached to the hydraulic body 3. It may be observed that, in all other respects, the characteristics of the piece 8 of this second embodiment are the same as the aforesaid piece 8 had in the first embodiment.

There is a third embodiment of the invention that combines the first two embodiments, in such a way that it includes a first piece 8 attached to the synchronous motor 1 and a second piece 8 integral with the hydraulic body 3. Although in the preferred execution of this third embodiment the first piece 8 is an independent piece and the second piece 8 is integral with the hydraulic body, the first piece 8 may also be integral with the body of the synchronous motor 1 and the second piece 8 may also be an independent piece.

What is claimed is:

1. A synchronous self-priming hydraulic pump for dishwashers and washing machines comprising:

a synchronous motor having an axis;

an impeller coaxial to said synchronous motor;

a hydraulic body, said impeller being housed in said hydraulic body, and said hydraulic body having an inlet pipe and an outlet pipe; and at least one directing piece positioned in an interior of said hydraulic body adjacent to said impeller, said directing piece having a substantially cylindrically shaped outer edge surface, coaxial and perpendicular to said axis, terminating in a continuous apex shaped projecting portion having a tip aligned towards an opening of said outlet pipe; wherein said apex shaped projecting portion directs flow circulating inside said hydraulic body towards said outlet pipe.

2. A synchronous hydraulic pump according to claim 1, wherein said directing piece is coaxial to said impeller and has a substantially cylindrical outline except at a projecting point, which is formed by two planes tangential to said cylindrical outline, said two planes extending towards said outlet pipe until they intersect.

3. A synchronous hydraulic pump according to claim 2, wherein said two planes extend towards a bottom of said outlet pipe.

4. A synchronous hydraulic pump according to claim 1, wherein said directing piece is placed between said impeller and said synchronous motor, said directing piece being attached to a housing of said synchronous motor.

5. A synchronous hydraulic pump according to claim 4, wherein said directing piece is an independent piece.

6. A synchronous hydraulic pump according to claim 4, wherein said directing piece is integral to said housing of said synchronous motor.

7. A synchronous hydraulic pump according to claim 1, wherein said directing piece is attached to said hydraulic body.

8. A synchronous hydraulic pump according to claim 7, wherein said directing piece is an independent piece.

9. A synchronous hydraulic pump according to claim 7, wherein said directing piece is integral to said hydraulic body.

10. A synchronous hydraulic pump according to claim 1, wherein:

said directing piece comprises a first piece fitted between said impeller and said synchronous motor and being attached to a housing of said synchronous motor, and a second piece attached to said hydraulic body.

* * * * *